United States Patent [19]

Viro et al.

[11] 3,989,529

[45] Nov. 2, 1976

[54] HYDROPHILIC COUPLER SOLUTIONS

[75] Inventors: Felix Viro, Apalachin, N.Y.; Salvatore Emmi, Portland, Oreg.

[73] Assignee: GAF Corporation, New York, N.Y.

[22] Filed: Oct. 29, 1974

[21] Appl. No.: 518,798

[52] U.S. Cl. ..... 96/100; 96/114.4; 106/125

[51] Int. Cl.[2] ..... G03C 1/31

[58] Field of Search ..... 96/100, 114.4, 114.2, 96/50 PT, 111; 106/125

[56] References Cited

UNITED STATES PATENTS

| | | | |
|---|---|---|---|
| 3,050,394 | 8/1962 | Ben-Ezra | 96/100 |
| 3,288,775 | 11/1966 | Anderau et al. | 96/111 |
| 3,413,123 | 11/1968 | Nittel et al. | 96/100 |
| 3,632,373 | 1/1972 | O'Connell | 96/100 |
| 3,676,144 | 7/1972 | Schulz | 106/125 |
| 3,749,573 | 7/1973 | Froehlich | 96/50 PT |

FOREIGN PATENTS OR APPLICATIONS

| | | | |
|---|---|---|---|
| 1,919,603 | 4/1969 | Germany | 96/50 PT |

*Primary Examiner*—Edward G. Whitby
*Attorney, Agent, or Firm*—Walter C. Kehm; Edward G. Comrie

[57] ABSTRACT

Hydrophilic coupler solutions are improved by the addition of a diepoxide, pyruvaldehyde, ethyleneglycol-diglycidyl ether or 2,3-butanedione. These solutions exhibit greater stability and a reduced rate of viscosity increase when admixed into gelatin silver halide emulsions.

19 Claims, No Drawings

HYDROPHILIC COUPLER SOLUTIONS

DETAILED DISCLOSURE

This invention relates to the preparation of improved gelatin silver halide emulsion compositions for use in color photography. More particularly, it relates to improved hydrophilic coupler solutions employed in the preparation of such gelatin silver halide emulsions.

Water soluble couplers are normally dissolved as alkali metal salts in water solution and these solutions are added to the gelatin silver halide emulsion prior to the casting of the emulsion onto a support. Many of the couplers used in the preparation of commercial color reversal photographic products exhibit poor stability in solution. Depending upon the individual coupler used, crystallization often occurs within a one-half hour to 24 hour period. Furthermore, as the concentration of coupler in solution is increased, the stability of the resulting aqueous solution decreases. Serious problems are encountered in connection with the manufacture of modern color reversal products in which the concentration of coupler is 10% or higher. These products are characterized by having thinner coatings and thus require gelatin silver halide emulsions with higher concentrations of silver. As a result, the coating formulations also tolerate less water which, in turn, requires more concentrated coupler solutions. It is therefore desirable, in the manufacture of gelatin silver halide emulsions to develop stable hydrophilic coupler solutions.

In the manufacture of gelatin silver halide emulsions, the hydrophilic coupler interacts with the gelatin and this interaction results in an increase in viscosity. Extensive studies have been done on this phenomenon; see, for example, Mazzucato et al, *The Journal of Photographic Science*, Vol. 16, page 63, (1968) and Evva et al, *Kolloid-Zeitscrift* 149, 10 (1956). Various methods are known which will reduce this viscosity increase, such as alteration of pH, addition of certain organic solvents, etc. Typical is Seidel et al, U.S. Pat. No. 3,409,435, which teaches the use of poly-1,3-propylene glycol ethers as a viscosity reducing agent. Additives of this nature are generally satisfactory in reducing the rate of viscosity increase, but, in most cases, their use creates other problems, such as, stability or difficulty in the coating process.

It is therefore an object of this invention to develop a hydrophilic coupler solution of increased stability. It is another object of this invention to develop such a hydrophilic coupler solution which would also have the effect of reducing the viscosity increase which occurs upon the admixture of the coupler solution into gelatin silver halide emulsions.

Other objects and advantages will be apparent from the following disclosure.

This invention provides new hydrophilic coupler solutions containing, as an additive, diepoxide, pyruvaldehyde, ethyleneglycoldiglycidyl ether or 2,3-butanedione. These solutions themselves exhibit greatly improved stability. Furthermore, when they are admixed into gelatin silver halide emulsions, the rate of viscosity increase is significantly reduced.

The color couplers which are contemplated for use in connection with the present invention include the hydrophilic couplers generally used in connection with color reversal systems. Such couplers can be generally described as phenol and naphthol type cyan couplers having an aliphatic chain of at least ten carbon atom and at least one sulfo or carboxy group to render thei alkali soluble; 1-phenyl pyrazolone type magenta cou plers having an aliphatic chain of at least ten carbo atoms and at least one sulfo or carboxy group to rende them alkali soluble; benzoyl acetanilide type yello couplers having an aliphatic chain of at least ten carbo atoms and at least one sulfo or carboxy group to rende them alkali soluble; and pivalyl acetanilide type yello couplers having an aliphatic chain of at least ten carbo atoms and at least one sulfo or carboxy group to rende them alkali soluble.

Examples of such couplers include:

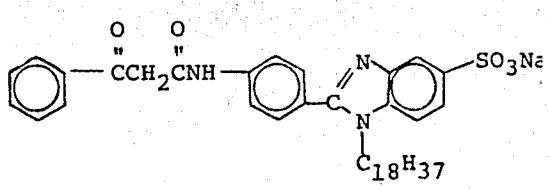

"A"

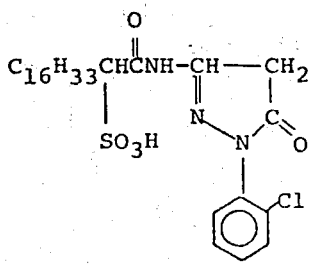

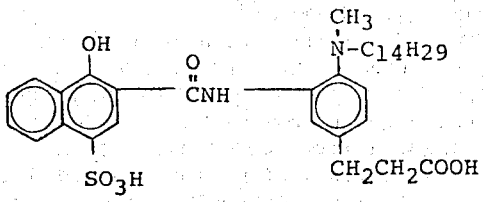

"C"

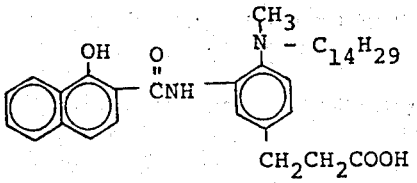

"D"

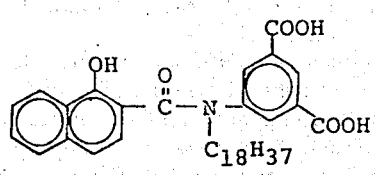

"E"

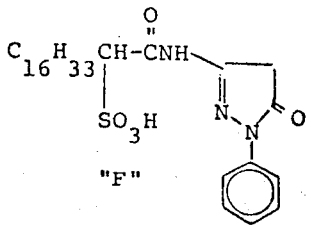

"F"

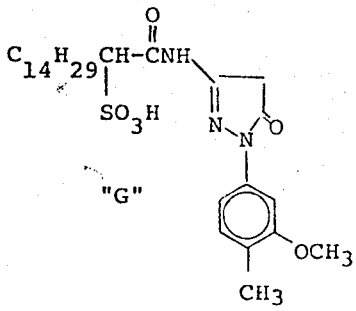

"G"

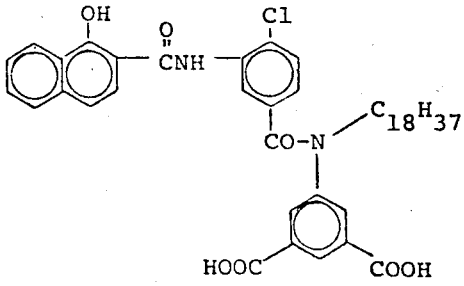

"H"

The concentration of these couplers in solution is generally between about 2% and 20% but preferably between about 5% and 10%.

The additives which are used in solution with the color couplers, according to this invention, include diepoxides, pyruvaldehyde, ethlenglycoldiclycidyl ether and 2,3-butanedione By the term "diepoxides" is meant low molecular weight resinous polymeric products, the molecular weight being between about 170 and 400. Especially useful is the condensation product of glycerin and epichlorohydrin. Other suitable diepoxides useable in the present invention include

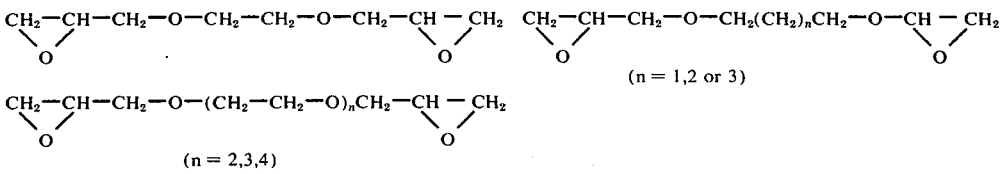

The amount of additives used will depend largely upon the particular hydrophilic coupler employed. Generally, the additive will be used in amounts of between about 1% and 20%, preferably 2% and 10% by weight of the coupler.

The actual concentration depends on the specific molecular weight relationship of color former to additive and the inherent solubility characteristics of the color former. The choice of an appropriate additive concentration is within the skills of persons knowledgeable in the art.

The hydrophilic coupler solutions of this invention are employed in the preparation of gelatin silver halide emulsions in the usual manner well known in the art.

This invention will be better understood by reference to the following examples which are included here for purposes of illustration and comparison and are not to be construed as limitations. Unless otherwise stated, all percentages and parts are by weight.

EXAMPLE 1

A 10% solution of coupler "A" is made by dissolving 10 grams of coupler "A" in 80 cc of water and 10 cc of methanol. The pH of this solution was 8.1. 43 ml. of the solution and 60 ml. of additional dilution water were added to 100 grams of medium speed bromoiodide emulsion, containing 5 mol % iodide, 5% silver and 7% gelatin. Within 15 minutes, the resulting solution became too viscous for coating.

EXAMPLE 2

A coating solution similar to that of Example 1 was made except that the solution of coupler A was adjusted to a pH of 6.8 prior to combining with the emulsion. This solution also became too viscous for coating within 15 minutes.

EXAMPLE 3

A coating solution similar to Example 1 was made except that the solution of coupler A was adjusted to pH 7.2 before combining with the emulsion. This solution also became too viscous for coating within 15 minutes.

EXAMPLE 4

A coating solution similar to Example 1 was made except that the coupler A solution was adjusted to a pH of 6.2 prior to combining with the emulsion. As in the previous examples, this solution became too viscous for coating within 15 minutes.

EXAMPLE 5

A 10% solution of coupler A was made by dissolving 10 grams of coupler A in 70 ml. of water, 10 cc of methanol and 20 ml. of a low molecular weight porous resinous diepoxide sold under the trademark Eponite 100, which is a condensation product of glycerine and epichlorohydrin. The resultant solution was combined with the medium speed bromoiodide emulsion used in Example 1. The resulting gelatin solution was still coatable after eight hours.

EXAMPLE 6

A solution of coupler A was made by dissolving 10 grams of coupler in 10 ml of acetone, 4 ml of the resinous diepoxide used in Example 5, and 1 ml of water. The solution was added to 105 ml of a 1% gelatin solution containing 5 ml of 10% sodium alkyl naphthalene sulfonate. A clear low viscosity solution resulted.

EXAMPLE 7

A solution similar to Example 6 was prepared but only 2 ml of the resinous diepoxide was used. A clear low viscosity solution resulted.

EXAMPLE 8

A solution similar to Example 6 was prepared but only 1 ml of resinous diepoxide was used. The result was a clear solution which turned viscous upon standing.

EXAMPLE 9

A solution similar to Example 6 was prepared but no resinous diepoxide was used. Here again, a clear solution resulted which turned viscous upon standing.

EXAMPLE 10

A 10% solution of coupler "B" was made by dissolving 10 gms. of coupler in 67 ml of water, 20 ml of one normal sodium hydroxide and 0.35 ml of the resinous diepoxide used in Example 5. The pH was adjusted to 6.8 and sufficient water was added to make 100 ml of solution. After 5 days, the solution was still clear.

EXAMPLE 11

A solution of coupler "B" similar to that on Example 10 was prepared except that no resinous diepoxide was used. The resulting solution exhibited a crystalline precipitate after 12 hours.

EXAMPLE 12

A 10% solution of coupler "C" was made by dissolving 10 gms. of coupler and 16 ml of water, 25 ml of one normal sodium hydroxide and 0.35 ml of the resinous diepoxide used in Example 5. The solution was stirred until all solid matter was dissolved, the pH was adjusted to 7.0 and sufficient water was added to make 100 ml of solution. After 5 days, the solution was still clear.

EXAMPLE 13

A solution similar to that of Example 12 was prepared except that no resinous diepoxide was employed. The solution showed a crystalline precipitate after 12 hours.

EXAMPLE 14

One gm of "coupler A" was added to 2 ml of methanol and heated to dissolve and then 2 ml of water was added. This solution was then added to 10 ml of a 5% gelatin solution at a temperature of 40° C. The resulting solution sets up immediately.

EXAMPLE 15

Example 14 was repeated with 0.5 ml of ethyleneglycol diglycidyl ether added to the coupler solution prior to combining with the gelatin solution. The solution gradually thickens.

EXAMPLE 16

Example 14 was repeated with the addition of 0.5 ml of pyruvaldehyde added to the coupler solution prior to combining with the gelatin solution. The solution remained free flowing after 24 hours.

EXAMPLE 17

Example 14 was repeated with 0.5 ml of 2,3-butanedione added to the coupler solution prior to combining with the gelatin solution. The solution remain free flowing after 24 hours.

EXAMPLE 18

Example 14 was repeated with 0.5 ml of 2,4-pentanedione added to the coupler solution prior to combining with the gelatin solution. The resulting solution shows gradual thickening.

EXAMPLE 19

Example 14 was repeated with 0.5 ml of epichlorohydrin added to the coupler solution prior to combining with gelatin solution. The resulting shows gradual thickening.

EXAMPLE 20

A solution of 5% coupler "D" was made by dissolving 5 gms of coupler in 16 ml of water and 25 ml of sodium hydroxide. The solution was stirred, the pH was adjusted to 7.0 and water was added to make 100 ml of solution. The color former crystallizes out upon cooling.

EXAMPLE 21

A solution similar to that of Example 20 was prepared except that 0.35 ml of the resinous diepoxide used in Example 5 was added. No precipitation was observed upon cooling.

The foregoing examples show the chief advantages derived from the practice of this invention — namely, stability of the coupler solution and decrease in the rate of viscosity increase upon admixing the coupler solution with gelatin. The fact that the additives have this effect is rather surprising since these additives are all recognized as gelatin hardeners which were used by adding them directly to gelatin solutions prior to coating. It has now been found that, if the same additives are incorporated in solution with the coupler, the above discussed advantages are obtained. It is apparent that the combination of these "hardeners" with color formers causes the hardeners to act in an unconventional manner. While not wishing to be bound by any specific theory, it appears that, through their solubilizing groups, they link the hydrophilic color formers into the gelatin matrix.

We claim:

1. A hydrophilic color coupler solution for use in gelatin silver halide emulsions comprising a water soluble color coupler having at least one solubilizing moiety selected from the group consisting of sulfo and carboxy moieties and an additive selected from the group consisting of a diepoxide, ethylene glycol diglycidyl ether, pyruvaldehyde and 2,3 butanedione.

2. A coupler solution according to claim 1 in which the additive is present in an amount ranging from about 1 to about 20 wt.% of the coupler.

3. A coupler solution according to claim 2 in which the additive is present in an amount ranging from 2 to 10 wt.% of the coupler.

4. A coupler solution according to claim 2 in which the additive is a diepoxide.

5. A coupler solution according to claim 4 in which the diepoxide is a resinous condensation product of glycerin and epichlorohydrin.

6. A coupler solution according to claim 2 in which the additive is ethylene glycol diglycidyl ether.

7. A coupler solution according to claim 2 in which the additive is pyruvaldehyde.

8. A coupler solution according to claim 2 in which the additive is 2,3-butanedione.

9. A coupler solution according to claim 2 in which the coupler is

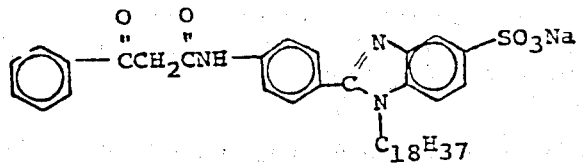

and is present in a concentration between about 2 and about 20%.

10. A coupler solution according to claim 9 in which the additive is a resinous condensation of glycerine and epichlorohydrin.

11. A coupler solution according to claim 9 in which the additive is ethyleneglycol diglycidyl ether.

12. A coupler solution according to claim 9 in which the additive is pyruvaldehyde.

13. A coupler according to claim 9 in which the additive is 2,3-butanedione.

14. A coupler solution according to claim 2 in which the coupler is

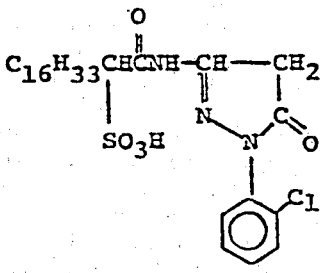

and is present in a concentration between about 2 and about 20%.

15. A coupler solution according to claim 14 in which the additive is a resinous condensation product of glycerine and epichloruhydrin.

16. A coupler solution according to claim 2 in which the coupler is

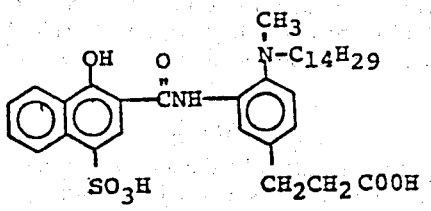

and is present in concentration between about 2 and about 20%.

17. A coupler solution according to claim 16 in which the additive is a resinous condensation product of glycerine and epihorohydrin.

18. A coupler solution according to claim 2 in which the coupler is

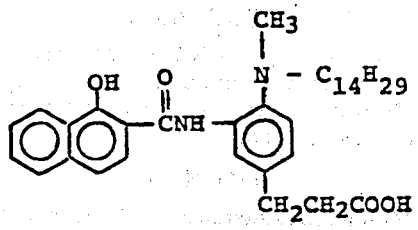

and is present in a concentration between about 2 and about 20%.

19. A coupler solution according to claim 18 in which the additive is a resinous condensation product of glycerine and epichloruhydrin.

* * * * *

Disclaimer 3,989,529.—*Felix Viro*, Apalachin, N.Y., and *Salvatore Emmi*, Portland, Ore. HYDROPHILIC COUPLER SOLUTIONS. Patent dated Nov. 2, 1976. Disclaimer filed Sept. 30, 1982, by the assignee, *Eastman Kodak Co.*

Hereby enters this disclaimer to all claims of said patent.

[*Official Gazette March 8, 1983.*]